US005244265A

United States Patent [19]

Chiang

[11] Patent Number: 5,244,265

[45] Date of Patent: Sep. 14, 1993

[54] TOOL CONTAINER

[76] Inventor: Ching-An Chiang, P.O. Box 82-144, Taipei, Taiwan

[21] Appl. No.: 881,735

[22] Filed: May 11, 1992

[51] Int. Cl.[5] ..... A47B 47/00

[52] U.S. Cl. ..... 312/107; 312/111; 312/902

[58] Field of Search ..... 312/107, 108, 111, 131, 312/312, 109, 261, 270.3, 244, 122, 902

[56] References Cited

U.S. PATENT DOCUMENTS

| | | | |
|---|---|---|---|
| 864,761 | 8/1907 | Erickson | 312/111 |
| 1,656,868 | 1/1928 | Davis et al. | 312/111 |
| 2,811,404 | 10/1957 | Brooks et al. | 312/122 |
| 3,606,506 | 9/1971 | Ungaro | 312/111 |
| 3,748,009 | 7/1973 | Stone | 312/108 |
| 4,303,158 | 12/1981 | Perkins | 312/902 |
| 4,643,494 | 2/1987 | Marleau | 312/107 |
| 4,659,154 | 4/1987 | Jenkins | 312/902 |
| 4,735,471 | 4/1988 | Riggsby | 312/312 |

FOREIGN PATENT DOCUMENTS

| | | | |
|---|---|---|---|
| 1297387 | 5/1962 | France | 312/111 |

*Primary Examiner*—Victor N. Sakran
*Attorney, Agent, or Firm*—Alfred Lei

[57] ABSTRACT

This invention relates to a tool container and in particular to one including a main body portion provided with two horizontal grooves at both opposite inner sides and a rack at both upper edges, a partition board inserted into an upper one of the two horizontal grooves, a drawer inserted into a lower one of the two horizontal grooves, two doors hingedly connected with the main body portion, a case provided with racks at bottom and top sides and engageable with the top of the main body portion and the top of another box, and a box engaged with the top of the case.

1 Claim, 3 Drawing Sheets

TOOL CONTAINER

BACKGROUND OF THE INVENTION

Heretofore, there are various kinds of containers for receiving tools on the market. However, none of them can be connected with additional boxes to enlarge their capacity and are satisfactory in use.

Therefore, it is an object of the present invention to provide an improved tool container which may obviate and mitigate the above-mentioned drawbacks.

SUMMARY OF THE INVENTION

This invention is related to a tool container.

It is the primary object of the present invention to provide a tool container which may be used to store various kinds of tools.

It is another object of the present invention to provide a tool container which may be connected with additional cases to enlarge its capacity.

It is still another object of the present invention to provide a tool container which is convenient to carry.

It is still another object of the present invention to provide a tool container which is compact in size.

It is a further object of the present invention to provide a tool container which is handy in use.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
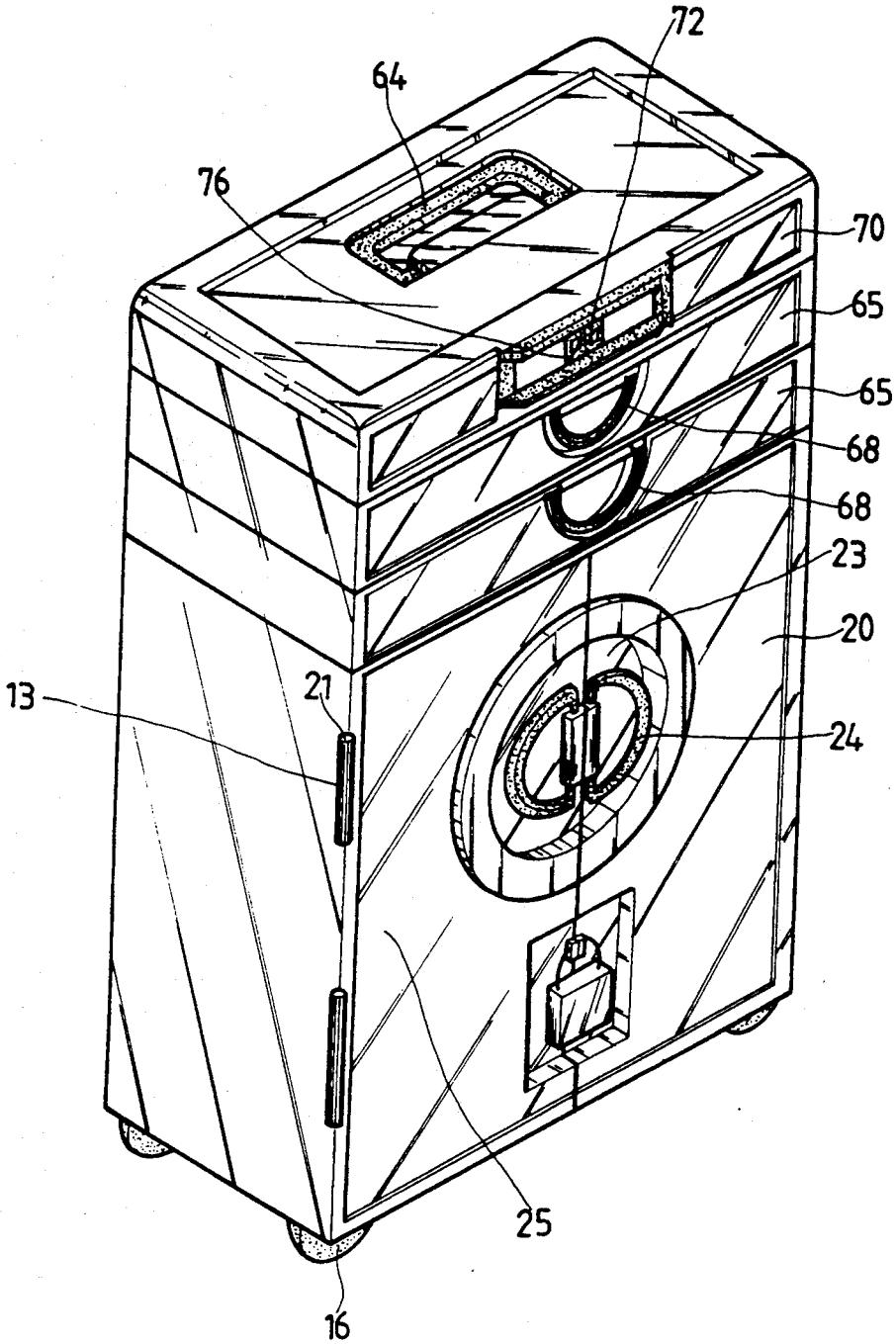
FIG. 1 is a perspective view of the present invention.
Figure 2:
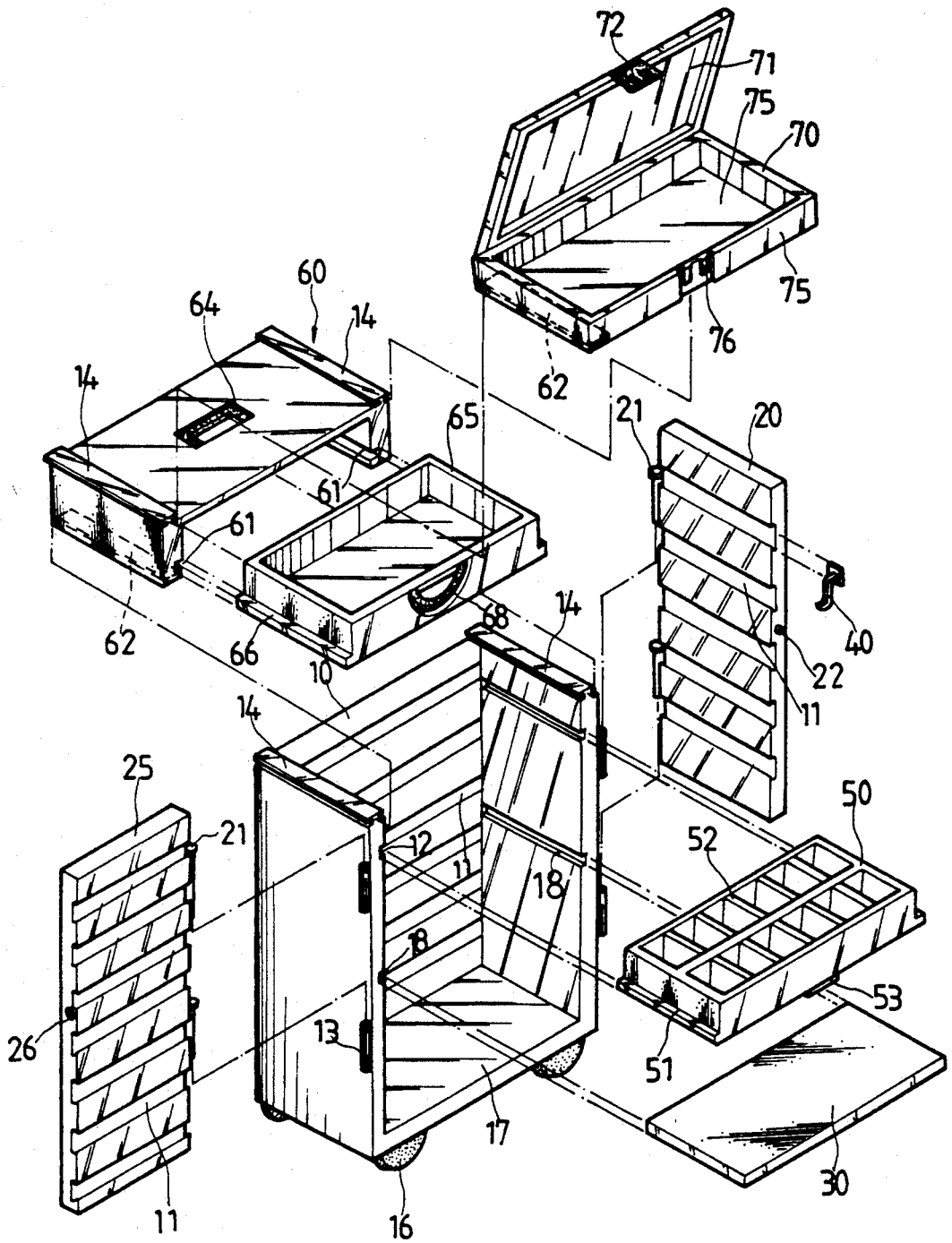
FIG. 2 is an exploded view of the present invention.
Figure 3:
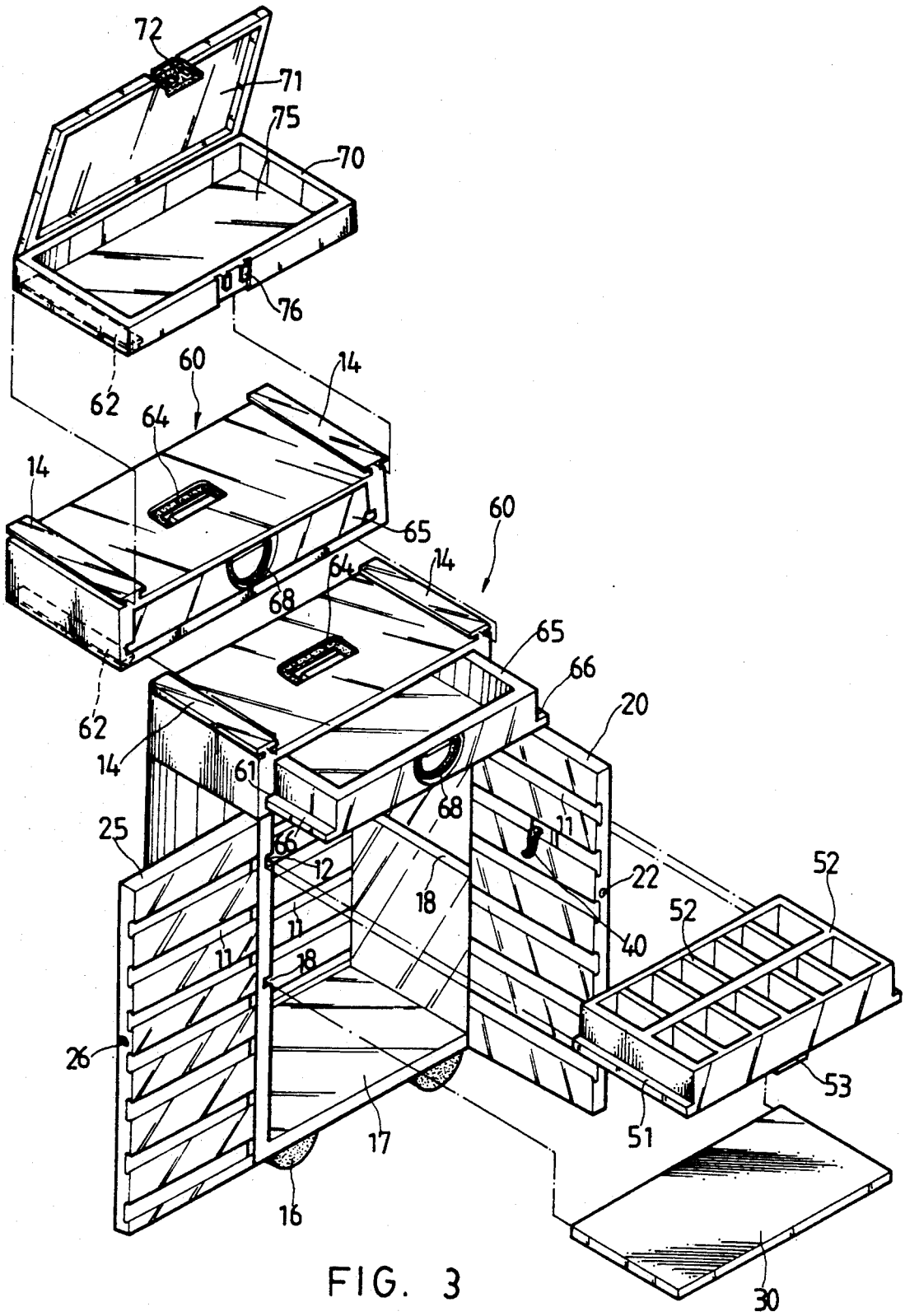
FIG. 3 shows an embodiment of the present invention.

With reference to the drawings and in particular to FIGS. 1 and 2 thereof, the tool box according to the present invention mainly comprises a main body portion 10 with two grooves 12 and 18 at both opposite inner sides. A drawer 50 having two lower flanges 51 is inserted into the upper portion of the main body portion 10 so that the lower flanges 51 of the former are engaged with the grooves 12 of the latter. Further, the drawer 50 is divided into a plurality of lattices by a plurality of movable partitions 52 so as to receive trivial things. In addition, the drawer 50 has a protuberance 53 on its bottom for making it easier to be pushed into or pulled out of the main body portion 10.

A partition board 30 is inserted into the main body portion 10 to divide it into two halves. Both sides of the main body portion 10 are provided with two barrels 13. A left door 25 having a two pins 21 adapted to engage with the barrels 13 of the main body portion 10 is mounted on left side of the main body portion 10. Further, a right door 20 having two pins 21 adapted to engage with the barrels 13 of the main body portion 10 is mounted on the right side of the main body portion 10. Hence, the two doors 20 and 25 may be turned open or close with respect to the main body portion. In addition, the right door 20 is provided with a spring-loaded ball 22 and the left door 25 has a recess 26 so that when the right door 20 and the left door 25 are turned close, the spring-loaded ball 22 of the left door 25 will be engaged with the recess 26 of the right door 20 thereby keeping the two doors in place. Moreover, both doors 20 and 25 are formed at the front side with a recess 23 in which there is mounted a handle 24. The inner sides of the doors 20 and 25 and the rear inner side of the main body portion 10 are formed with a plurality of horizontal slots 11 for engaging with a plurality of hooks 40.

The top of the main body portion 10 is provided with two racks 14 which are engaged with a case 60 having two grooves 61. A drawer 65 is inserted into the case 60 with its flanges 66 engaged with the grooves 61 of the case 60 and has a handle 68 in the front side. Further, the case 60 has a handle 64 on the top. A box 70 provided with racks 14 is engaged with the upper racks 14 of the case 60. The box 70 is composed of a lid 71 and a body 75 which are respectively provided with a male retainer 72 and female retainer 76 which are engageable with each other. Further, there is a handle 78 (not shown) on the top of the box 70.

Although the present invention has been described with a certain degree of particularity, it is understood that the present disclosure is made by way of example only and that numerous changes in the detail of construction and the combination and arrangements of parts may be resorted to without departing from the spirit and scope of the invention as hereinafter claimed.

I claim:

1. A tool container comprising:

a main body portion provided with two horizontal grooves at both opposite inner sides and a rack at both upper edges;

a partition board inserted into a lower one of said two horizontal grooves;

a drawer having two lower flanges inserted into an upper one of said two horizontal grooves and divided into a plurality of lattices by a plurality of movable partitions;

two doors hingedly connected with said main body portion, said doors being provided with a plurality of horizontal slots for engaging with a plurality of hooks;

a case provided with racks at bottom and top sides and engageable with a top of said main body portion, said case having a handle on a top and receiving a drawer with a handle in a front side; and a box engaged with a top of said case and having a closable lid.

* * * * *